United States Patent [19]

Angove

[11] 4,147,347

[45] Apr. 3, 1979

[54] POOL TABLE CROQUET GAME EQUIPMENT

[75] Inventor: Donald A. Angove, Kent, Wash.

[73] Assignee: Victory Games, Inc., Seattle, Wash.

[21] Appl. No.: 852,484

[22] Filed: Nov. 17, 1977

[51] Int. Cl.[2] ..... A63B 67/04

[52] U.S. Cl. ..... 273/57

[58] Field of Search ..... 273/14, 56, 57

[56] References Cited

U.S. PATENT DOCUMENTS

| | | | |
|---|---|---|---|
| 122,830 | 1/1872 | Heyl | 273/57 |
| 197,504 | 11/1877 | Van Hoevenbergh | 273/57 |
| 1,206,194 | 11/1916 | Becker et al. | 273/57 |
| 1,576,145 | 3/1926 | Searle | 273/57 |
| 2,006,497 | 7/1935 | Couse | 273/76 |
| 2,010,282 | 8/1935 | Wannemacher | 273/14 |

FOREIGN PATENT DOCUMENTS

| | | | |
|---|---|---|---|
| 22494 of | 1903 | United Kingdom | 273/57 |

*Primary Examiner*—William H. Grieb
*Assistant Examiner*—T. Brown
*Attorney, Agent, or Firm*—Graybeal, Barnard & Uhlir

[57] ABSTRACT

Pool table croquet game equipment is produced in several components, many of which are the same, for convenience of manufacture, assembly, use, and storage, to play a game on a pool table using pool cues and pool balls in a procedural way very similar to playing lawn croquet. The nine croquet like arches or hoops, through which the pool balls are shot, are equipped at their tops with integral dual direction hollow receivers and at their bottoms with snap on feet, adjustable if necessary for the vertical alignment of the arches or hoops. These nine croquet like arches or hoops are positioned about the pool table top in relative positions similar to the positions of the arches used in playing lawn croquet. To keep them firmly and accurately spaced, they are joined together by using various tubes which are provided in essentially two groups of like lengths. Each tube passes through at least one of the integral dual directional hollow receivers at the tops of the nine croquet like arches or hoops. Two cross plugs to fit inside tube ends are used and also each tube has at least one end coupling with a set screw, whereby the nine croquet like arches or hoops are positioned accurately on the pool table. They so remain, unless disassembly procedures are undertaken, or as so assembled, this assembled pool table croquet game equipment may be temporarily lifted off of a pool table to be used elsewhere or to be set aside during the play of a pool game or other game.

9 Claims, 4 Drawing Figures

POOL TABLE CROQUET GAME EQUIPMENT

BACKGROUND OF THE INVENTION

In 1872, H. R. Heyl, in his U.S. Pat. No. 122830, illustrated and described how the opposite side of a playing surface side of a billiard table could be rotated upwardly and equipped iwth nine arches or hoops and two posts, so a game could be played with billiard cues and billiard balls following the procedures of playing lawn croquet. In 1877, Henry Von Hoevenbergh in his U.S. Pat. No. 197504 illustrated and described how nine arches and two posts could be secured to a removable table cover. Then the cover, so equipped, could be placed on a dining room table, so a game like or similar to croquet could be played. Later in 1916, Messrs. Becker and Gissberg in their U.S. Pat. No. 1,206,194 illustrated and described equipment for placement on a billiard table to play an indoor croquet like game using billiard cues and billiard balls. Two posts were secured at each end of the billiard table and then a telescoping and foldable overall assembly, positioning the included nine arches or hoops, was secured to the sides of the billiard table.

It is not known how long game equipment like Messrs. Heyl, Von Hoevenberg, Becker and Gissberg was used. Apparently, however, considerable time elapsed when such game equipment was not available. More recently the Applicant provided equipment for a pool table croquet like game. However, after some marketing experience, the Applicant made improvements to reduce the manufacturing operations and costs, and also to make the equipment more convenient for the customer to assemble and disassemble. As initially introduced, many components had to be adhesively secured together and therefore not thereafter disassembled. Also the arches or hoops were provided in two groups depending on where they were to be positioned. These and other features of the equipment although still serving the customer well were changed to serve the customer better and to reduce the manufacturing, packaging, inventory, tooling costs, and assembly and disassembly time, the latter becoming essentially a complete disassembly by a customer if desired.

SUMMARY OF THE INVENTION

Today, arranged in a clear plastic bag about twenty inches long and three inches in diameter, nine arches or hoops with their horizontal positioning supporting tubes, in two groups of respective diameters, end couplings, two cross overs, screw fasteners, feet, and plugs are provided, so a customer may quickly assemble these components, needing only a screwdriver, to create pool table croquet-like game equipment. When this equipment is supplemented by utilizing a pool table, its playing surface and cushions, the pool cues and pool balls, a very interesting game may be played and enjoyed. Or this assembled equipment may be used on a floor or another table top and used in conjunction with small size croquet mallets and croquet balls.

Each of the nine arches or hoops at its top has an integral dual direction hollow receiver, so they may be selectively secured to a horizontal positioning supporting tube of smaller diameter and be arranged with the arch or hoop being either parallel to or perpendicular to the horizontal supporting tube. Also each leg of each of the nine arches or hoops has a pin bottom to receive a foot having a central recess frictionally fitted about the pin. Each horizontal positioning tube of larger diameter has at each of its ends a secured coupling sleeve having a hole in the sleeve to accommodate a screw used in tightening either an inserted horizontal positioning tube of smaller diameter or a plug like cross over. The plugs are used to close the unused directional passageway of a hollow receiver on an arch.

DESCRIPTION OF THE DRAWINGS

A preferred embodiment of the pool table croquet game equipment is illustrated in the drawings, wherein.

DESCRIPTION OF THE INVENTION

Figure 1:
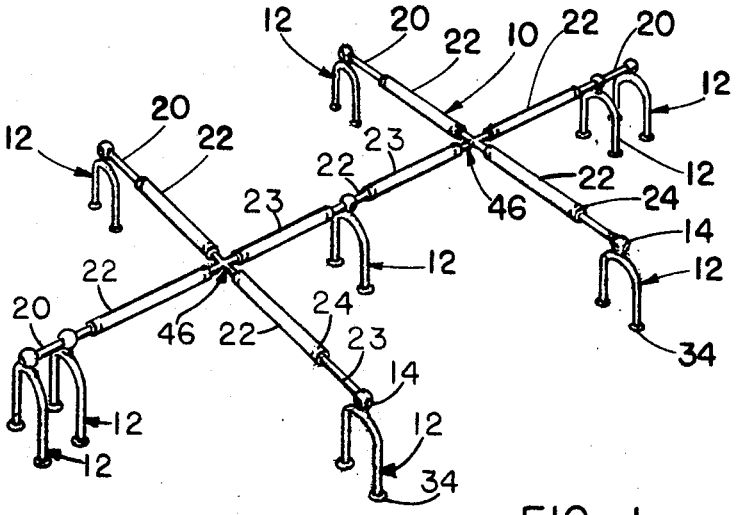
FIG. 1 is a perspective view of the pool table croquet game equipment assembled for placement on a pool table or other playing surface.

Throughout FIGS. 1 through 4, a preferred embodiment of the pool table croquet game equipment 10 is illustrated. The overall assembled configuration is set forth in FIG. 1 and selected portions thereof are enlarged in FIGS. 2, 3, and 4, to further show the various components and their assembled relationships.

The nine croquet arches 12, or hoops 12, have at their tops integral dual direction hollow receivers 14, creating a passageway 16 parallel to the arch or hoop 12, and also a passageway 18 perpendicular to the arch or hoop 12, thereby making them universally adapted to be mounted at any one of the nine arch locations. Each of them are mounted on a horizontal positioning and supporting tube 20 which is one of seven, which are of a smaller diameter and preferably fourteen inches long. At the commencement and half way locations of the game equipment 10, two of these arches or hoops 12 are mounted on one of these tubes 20 of smaller diameter, and at the other five locations only one arch 12 is mounted on such a tube 20.

These various subassemblies of arches 12 and smaller tubes 20 in their seven locations, as illustrated in FIG. 1, are held there by using eight horizontal, positioning, and supporting tubes 22, 23 of a slightly larger diameter which telescope over the tubes 20 of smaller diameter. These larger tubes 22, 23 are arranged in one group of six, 22, which are fourteen inches long, and another group, of two, 23, which are eighteen inches long. The latter two, 23, are used on each side of the center arch 12, along the overall longitudinal centerline of the assembled pool table croquet game equipment 10.

By using the telescoping horizontal positioning tubes of the relative smaller and larger telescoping diameters, 20, 22, 23, and equipping each end of the tubes 22, 23 of larger diameter with a coupling sleeve 24, which has and positions a screw fastener 26, the overall final arrangement and positioning of the nine arches or hoops 12 is optionally undertaken to accommodate pool tables, other tables, or other playing surfaces, which may be of different sizes, as the respective telescoping subassemblies 28 may be varied in their final assembled length.

To provide better bearing or contact area and also to permit some leveling, if necessary, all legs 30 of the arches or hoops 12, terminate in an extended pin 32. Then snapped onto these pins 32 are feet 34, which have centered recessed structures 36 sized to firmly receive and grip the extended pins 32.

Figure 4:
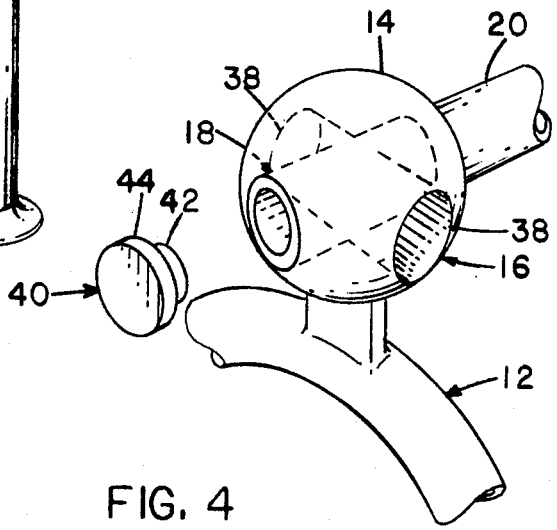
FIG. 4 is a partial further enlarged perspective view of the top integral dual direction hollow receiver on an arch or hoop, which is broken away only for illustrative purposes, and of a portion of a horizontal positioning tube of smaller diameter extending into the dual direction hollow receiver, and also of a plug used to close any entries or exits of the dual direction hollow receiver.

For closing any of the passageway entries 38, snap in place plugs 40, having an insertable portion 42 and an outer flange 44, are used when wanted. For example, at each longitudinal end of the overall pool table croquet game equipment 10, these snap in plugs 40 are used to help position an arch or hoop 12 at the end of a horizontal positioning and supporting tube 20 of smaller diameter, as illustrated in FIG. 4.

Figure 2:
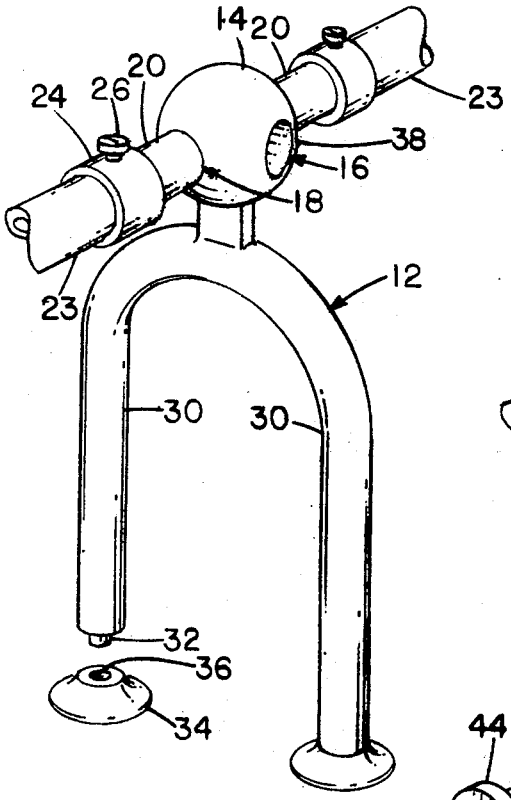
FIG. 2 is a partial enlarged perspective view of the center portions of the pool table croquet game equipment, with positions of the horizontal positioning tubes of larger diameter being broken away and a foot removed from a leg of an arch or hoop.

The arrangement of the arch or hoop 12 at the center of the overall equipment 10, is shown in FIG. 2. A tube 20 of smaller diameter receives the arch 12 at its center, using the passageway 18 of the integral dual direction hollow receiver 14, and then its respective ends are telescoped into the respective tube ends of the tubes 23 of larger diameter. Thereafter the selected overall telescoped lengths of the tubes 20 and 23 are maintained as the screw fasteners 26 are tightened.

Also in FIG. 2, the snap on foot 34 is illustrated. Each leg 30 of each arch or hoop 12 terminates in a pin 32. A complementing recessed structure or hole 36 of the snap on foot 34 fits adjustably but snugly around the pin 32, thereby increasing the footprint supporting area, and permitting some vertical alignment adjustments of the arches or hoops 12 to the playing surfaces and/or to the horizontal tubes 20, 22, 23.

Figure 3:
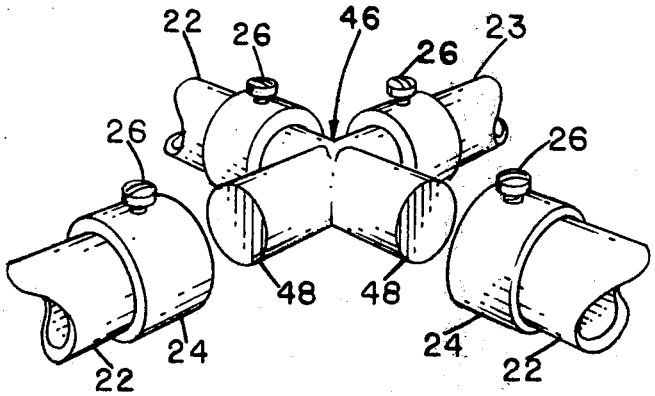
FIG. 3 is a partial enlarged perspective view of one of the two cross over structural plug connectors connected to two horizontal positioning tubes of larger diameter by using their end couplings and screw fasteners, and about to be connected to two others, with all four horizontal positioning tubes being cut off only for illustrative purposes.

One of the two cross over locations is illustrated in FIG. 3, wherein one of two cross over multiple plug connectors, 46, having the four insertable integral plug ends, 48, is used to interconnect the four horizontal positioning tubes of larger diameter 22, 23, coming from the four respective directions, establishing four respective ninety degree included angles. Their selected positions are maintained by tightening the screws 26, which are positioned by the coupling sleeves 24, which are permanently secured to the tubes 22, 23 of larger diameter.

In the enlarged view of FIG. 4, the integral dual direction hollow receiver 14 of an arch or hoop 12 is illustrated. Dotted lines indicate the unused passageway 16, which is arranged parallel to the arch or hoop 12. Also dotted lines show a portion of a horizontal positioning tube 20 of smaller diameter inserted into the passageway 18, which is perpendicular to the arch 12. A capping plug 40, having an insertable portion 42 and a flange 44 is illustrated opposite the entry 38 of passageway 18, where it may be inserted to help position the arch or hoop 12 on the tube 20. Also a like capping plug 40 is insertable in any entry 38, such as the entries 38 of the unused passageway 16, which is parallel the the croquet arch or hoop 12, to improve the overall appearance of the assembled pool table croquet game equipment 10.

It is to be noted that each passageway 16, 18 is slightly elliptical in shape. Therefore when a tube is inserted, the resulting frictional fit tends to keep the tube from being easily rotated.

I claim:

1. A pool table croquet game equipment, comprising:

(a) nine vertically extending hoops, each hoop having the shape of a conventional croquet hoop and having at its top an integral dual direction hollow spacer receiving member, said hoops being spaced apart and in respective conventional croquet playing positions; and (b) a plurality of telescoping horizontal, longitudinal and transversely positioned spacer tubes, each spacer tube having one its ends telescopically received by one of said spacer receiving members of each of said hoops and supporting said hoops in said spaced apart and vertical positions.

2. Pool table croquet game equipment, as in claim 1, comprising in addition, two cross overs, each having four plugs, for entry into tube ends of respective telescoping subassemblies of the horizontally positioned tubes, thereby serving to interconnect their longitudinal and transverse subassemblies at two locations.

3. Pool table croquet game equipment, as in claim 2, wherein each of said spacer tubes comprises two tube sections, one of said sections telescopically receiving the other, fastener means firmly holding said sections together and fastener means firmly connecting the ends of each said spacer tube to a said cross-over member and to a said spacer receiving member.

4. Pool table croquet game equipment, as in claim 3, wherein each leg of each hoop terminates in a pin; a foot member, said foot member having a centered recess therein said pin of each leg being received by said recess in each foot member for attaching a foot member to a respective leg of said hoop.

5. Pool table croquet game equipment, as in claim 4, wherein said spacer receiving member of at least some of said hoops is provided with a cap, said cap having flange and plug portions, said plug portion being inserted into a hollow portion of said spacer receiving member when said hollow portion is not occupied by a said spacer tube end.

6. Pool table croquet game equipment, as in claim 5, wherein said telescoping horizontally positioned tubes is comprised of a group of seven tubes of smaller diameter called the inside tubes, and a group of eight tubes of larger diameter called the outside tubes.

7. Pool table croquet game equipment, as in claim 6, wherein said group of seven inside tubes are each fourteen inches long, and wherein said group of eight outside tubes has six tubes fourteen inches long, and two tubes eighteen inches long.

8. Pool table croquet game equipment as in claim 1, wherein the hollow portion of each of said dual direction hollow spacer receiving members is slightly elliptical in their receiving spaces.

9. Pool table croquet game equipment, comprising:

(a) nine hoops having the shape of conventional croquet hoops and having hoop support engaging means attached thereof, said nine hoops being adapted to be spaced in conventional croquet playing positions; and (b) a plurality of telescoping hoop support tubes, each being adapted to be horizontally positioned, and to have at least one of its ends engaged by said engaging means of each of said hoops for holding said hoops in said conventional croquet playing positions, said engaging means being adapted to telescopically receive said at least one end of a said support tube, whereby each of said hoops is supported in a vertical position.

* * * * *